US006065376A

United States Patent [19]

Khachatoorian

[11] Patent Number: 6,065,376

[45] Date of Patent: May 23, 2000

[54] AUTO-ADJUSTING PLIERS

[75] Inventor: Zareh Khachatoorian, Northridge, Calif.

[73] Assignee: Olympia Industrial, Inc., City of Industry, Calif.

[21] Appl. No.: 09/104,823

[22] Filed: Jun. 25, 1998

[51] Int. Cl.[7] ..... B25B 7/04

[52] U.S. Cl. ..... 81/407; 81/341; 81/355

[58] Field of Search ..... 81/91.1, 91.3, 81/341, 355, 368, 370, 375, 426, 452, 454, 407

[56] References Cited

U.S. PATENT DOCUMENTS

| | | | |
|---|---|---|---|
| 5,176,049 | 1/1993 | Neff | 81/360 |
| 5,351,584 | 10/1994 | Warheit | 81/407 |
| 5,609,080 | 3/1997 | Flavigny | 81/368 |

*Primary Examiner*—James G. Smith
*Assistant Examiner*—David B. Thomas
*Attorney, Agent, or Firm*—Lackenbach Siegel Marzullo Aronson & Greenspan, P.C.; Myron Greenspan

[57] ABSTRACT

An auto-adjusting plier includes a first elongate member having a fixed jaw at one end, first elongate handle at the other end and a first neck portion. A second elongate handle has one end pivotally connected on the fixed jaw for pivotal movements. A second elongate member has a movable jaw at one end arranged in substantial opposition to the fixed jaw and another end mounted on the second elongate handle. An elongate link has one end pivotally mounted on a second neck portion of the second elongate member and the other end mounted for both pivotal and linear movements on the first elongate handle. Slots or channels are provided on the first neck portion for selectively guiding a stop pin mounted on the second neck portion and for selectively guiding the other end of the link generally linearly along a first predetermined length of the first handle. A third guide slot selectively guides the other end of the second elongate member generally linearly along a second predetermined length of said second handle. The stop pin is associated with the first guide slot or channel for selectively terminating continued generally linear movements of the stop pin along the first guide means after the jaws engage a work, the stop pin limiting continued relative movements of the second elongate member to pivoting movements of such member relative to said first elongate member. Springs urge the handles to normally separate when no gripping forces are applied to the handles and to normally maintain the other end of the link in the initial position of the second guide slot and the other end of the second elongate member at the initial position of the third guide slot before the jaws engage a work.

23 Claims, 8 Drawing Sheets

AUTO-ADJUSTING PLIERS

BACKGROUND OF THE INVENTION

1. Field of the Invention

The present invention generally relates to hand tools and, more specifically, to improved automatically adjustable pliers.

2. Description of the Prior Art

Numerous self-adjusting slip-joint pliers have been proposed. Such pliers share a number of common characteristics, including jaws that are offset at an angle to the longitudinal direction of the handles, and a pivot post in the form of a bolt or rivet mounted on the jaw of one of the handles and projecting through an elongated slot or channel on the other handle. In such pliers, the distance or the spacing between the work-gripping jaws is adjusted by a number of different designs, such as spaced apart ridges or teeth along the inside long edge of the slot adopted to selectively engage the pivot post. Another one of the methods for providing distance adjustment between the jaws in such pliers is to provide spaced-apart arcuate ridges on the interfacing surfaces adjacent the pivot point. All such tools have the common objective of adjusting to the size of the particular work piece to be gripped between the jaws. Typically, the use of such tools has required a two-handed operation wherein the handles are pulled wide apart to permit a sliding action of the pivot post along the slot to move the jaws into contact with the desired work piece.

In some cases, the pliers have been constructed for single-handed adjustments. Such pliers are adapted to slidably close on a work piece in response to manual closing action of the handles. The pliers automatically lock in response to contact of the jaws with the work piece against further sliding action and shift from a sliding to a pivoting mode in which continued exertion of manual force on the handles causes increased gripping action on the work piece. Such a pliers is disclosed in U.S. Pat. No. 4,651,598, and, aside from the sliding action of the bolt through the channel prior to engagement of a work, the pliers' movable or operative parts are limited to only one degree of freedom of linear movement after the work has been gripped between the jaws. This limitation severely restricts the adjustability for compensating for different sized works and bringing the jaws and handles into alignment.

In U.S. Pat. No. 4,662,252, an auto-grip pliers is disclosed which is capable of automatically adjusting the distance between the gripping jaws in relation to the size of the work piece to be gripped. The pliers utilizes one or more hidden springs to cause the automatic adjustment function. In this patented design the handle members are interconnected by a cross over linking arm. The linking arm is a rigid planar part having a first end normally positioned against a stop as a result of the pulling force of a spring within one of the handles. The other end of the linking arm is pivotally mounted on the other handle. Unlike many slip joint pliers, which are usually mass produced by drop forging operations, in which the handles and the jaws are made of solid metal, the pliers disclosed in this patent are formed of stamped metal parts which, in some cases, are laminated to form thicker pliers elements, as required. As with the previous patent, the operative parts of the pliers are limited to a single degree of freedom of movement after the work has been engaged.

Another automatically slidably adjustable pliers tool is disclosed in U.S. Pat. No. 4,893,530, in which the jaws can be automatically adjusted in response to the closing of the handles to the size of any workpiece or other item to be gripped within a size range defined by the maximum opening between the tool jaws. As with the tool disclosed in the previously mentioned patent, a rigid control arm extends from one handle to the other handle, the arm being pivotally mounted on one of the handles and pivotally and slidably mounted on the other handle. Again, as with the previously described patents, the ability to bring the jaws and handles into substantial parallelism is severely restricted by a single degree of freedom of linear movement of the operative parts after the work is engaged.

The known self-adjusting pliers have all had a number of disadvantages. First, while some of these known pliers have attempted to effect an adjustment of at least one of the jaws to bring the jaws into substantial parallel alignment following the shift from the sliding to the pivoting mode, the known constructions have not had the self-adjusting range to effect parallel jaw gripping surface alignment but for a small range of sizes of works. For works outside of the range the jaw surfaces have either undercompensated or overcompensated, depending on the specific design, and the target range of work sizes intended to be gripped by the jaws. Another disadvantage of prior art adjusting pliers has been that the handles have been variably spaced when gripping differently sized works. For large works, for example, the handles are typically spaced greater than a desired spacing for optimum gripping of the handles by the hands of a user, thus preventing the user from comfortably gripping the pliers and transmitting the maximum amount of force to the handles. Ideally, the handles should always settle at an optimum position in which the handles are spaced a desired distance apart and are substantially parallel to each other for all sizes of works. Again, because known pliers have not had the sufficient adjustability range to equally accommodate different sized works, they have not been able to provide the optimum handle spacing and parallelism but for a very small range of sizes of works.

One of the objectives of all pliers is to be able to grip the work with sufficient force so that there is no slipping between the work and the surfaces of the jaws. This sometimes requires substantial application of force on the handles of the pliers and on the jaws. Generally, the more force that is applied by the jaws to the work the less likely that slipping will occur, particularly when the jaw gripping surfaces are parallel to each other while gripping the work. However, known adjustable pliers are typically simple, single pivot lever devices where the mechanical advantage gained can be readily computed by comparing the lengths of the handles or arms to which the forces are applied and the sizes of the jaws and the points of application of force by the jaws to the work. Unfortunately, the mechanical advantage offered or provided by such known pliers has sometimes been insufficient to result in the desired forces being applied to the work based on the maximum forces that the user can apply to the handles. The inability to apply sufficiently high forces to the work, as aforementioned, may result in slipping between the jaws and the work and even injury to the user or damage to the work itself.

SUMMARY OF THE INVENTION

It is one of the objects of the present invention to provide an improved auto-adjusting pliers which overcomes or eliminates the disadvantages in similar known pliers.

It is another object of the present invention to provide an improved auto-adjusting pliers which is simple in construction and economical to manufacture.

It is still another object of the present invention to provide an improved auto-adjusting pliers as suggested above which is convenient to hold and to use.

It is yet another object of the present invention to provide an improved auto-adjusting pliers as in the previous objects which has improved ergonomics and has sufficient self-adjusting ranges to cause the handles to move to substantially the same parallel positions for differently sized works to enable the user to apply maximum forces to the handles and, therefore, maximum forces by the jaws to the work.

It is a further object of the present invention to provide an improved auto-adjusting pliers as in the previous objects which has sufficient self-adjusting ranges to move the gripping surfaces of the jaws of the pliers into substantially parallel orientations for differently sized works.

It is a still a further object of the present invention to provide an improved auto-adjusting pliers as suggested in the aforementioned objects which enhances the mechanical advantage provided by such pliers to significantly increase the forces that can be applied by the jaws to a work for a given force applied by the user to the handles.

It is yet a further object of the present invention to provide an improved auto-adjusting pliers which can be formed of lower cost stamped metal parts without losing the benefits normally obtained with corresponding solid metal parts.

In order to achieve the above objects, including others which will become evidently hereafter, a self-adjusting pliers for automatically adjusting to different sized work pieces in accordance with the present invention comprises a first elongate member having a first jaw at one end, a first elongate handle at the other end and a first neck portion between said first jaw and said first handle. A second elongate handle is provided having one end pivotally connected to said first jaw for pivotal movements between a normally open or releasing position and a closed or gripping position. A second elongate member is provided which has a second jaw at one end arranged in substantial opposition to said first jaw and having another end mounted on said second elongate handle for movements responsive to pivoting movements of said second elongate handle relative to said first jaw, and a second neck portion provided between said second jaw and said other end of said second elongate member. An elongate link is provided which has one end movably mounted on said second neck portion and another end movably mounted on said first elongate handle for movements responsive to movements of said second elongate member relative to said first elongate member. First elongate guide means is provided on said first neck portion arranged along a direction substantially parallel to the direction of relative movements between said jaws prior to engagement of a work by said jaws. Second elongate guide means for selectively guiding one linearly movable end of said link generally linearly along a first predetermined length of one or both of said first handle and said second neck portion between initial and extended positions. A third elongate guide means is provided for selectively guiding said other end of said second elongate member generally linearly along a second predetermined length of said second handle between initial and extended positions. Stop means is associated with said first guide means for selectively terminating continued generally linear movements of said second neck portion along said first guide means following engagement of a work by said jaws, and limiting continued generally linear relative movements of said jaws to pivoting movements of said jaws about said stop means. Biasing means is provided for urging said handles to normally separate when no gripping forces are applied to said handles and for urging and normally maintaining said one linearly movable end of said link at said initial position of said second guide means and said other end of said second elongate member at said initial position of said third guide means prior to engagement of a work by said jaws. Said second jaw is arranged to substantially linearly advance towards said first jaw prior to gripping of a work by said jaws, gripping of the work between said jaws causing said stop means to convert further application of forces to said handles to relative pivoting movements between jaws and causing said jaws to move to substantially parallel orientations primarily due to compensating linear movements of said one linearly movable end of said link and second elongate member from said initial positions toward said extended positions along said respective second and third guide means against the forces of said biasing means. Said second elongate guide means may comprise one or more slots on said first handle, said second neck portion or on said link.

BRIEF DESCRIPTION OF THE DRAWINGS

These and other objects, features and characteristics of the present invention will be more fully apparent, understood and appreciated from the ensuing detailed description, when read with reference to the various figures of the accompanying drawings, wherein.

DESCRIPTION OF THE PREFERRED EMBODIMENTS

Figure 1:
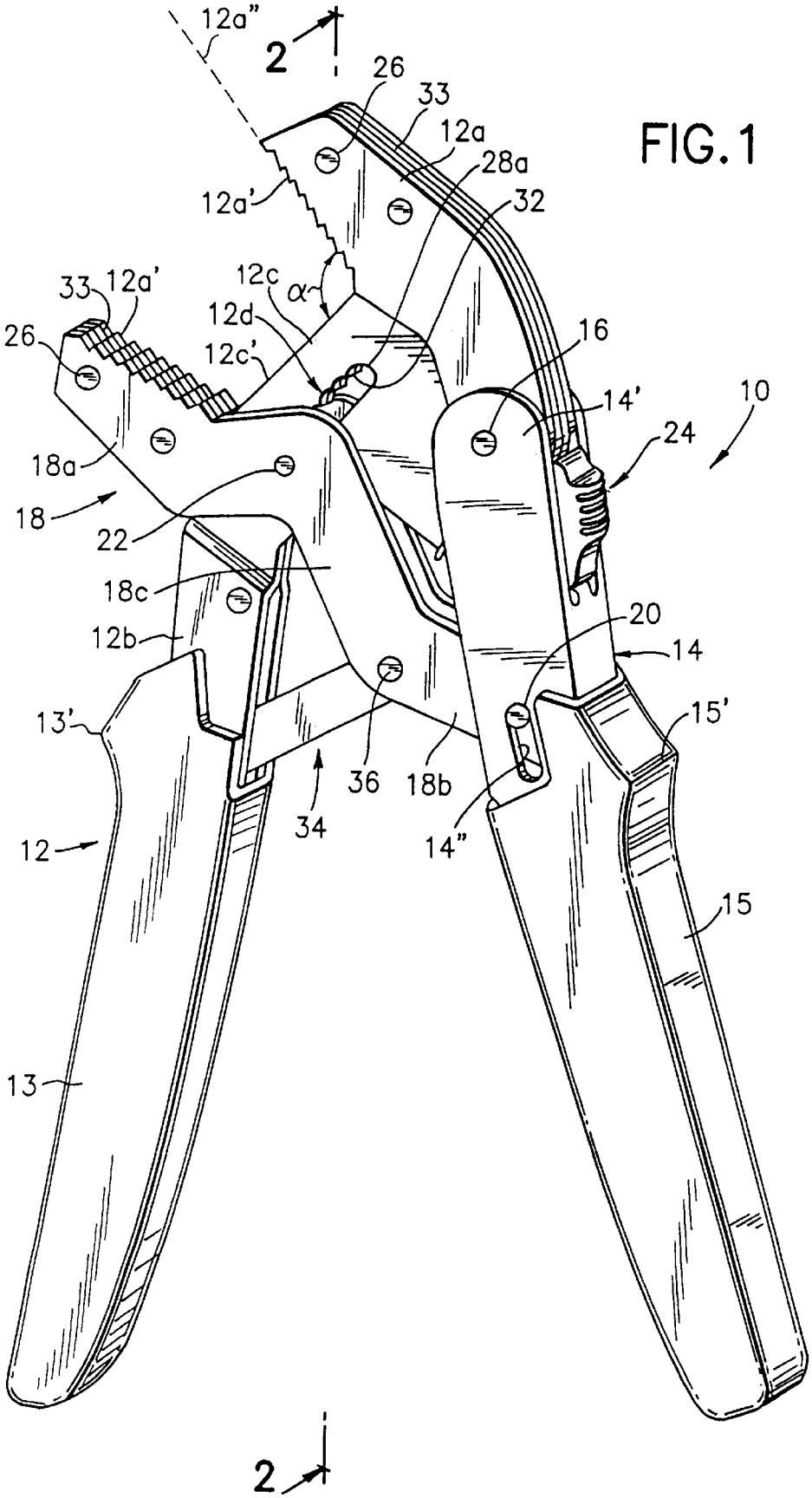
FIG. 1 is a perspective view of the improved auto-adjusting pliers in accordance with the present invention, shown with the handles and jaws in the fully open or released position.

Referring now specifically to the figures, in which identical or similar parts are designated by the same reference numerals throughout, and first referring to FIG. 1, a presently preferred embodiment of the improved auto-adjusting pliers is generally designated by the reference number 10.

The pliers 10 includes a first elongate member 12 having a fixed jaw 12*a* at one end, a fixed elongate handle 12*b* at the other end and a neck portion 12*c* between and connecting the fixed jaw 12*a* and the handle 12*b*. The fixed elongate handle 12*b* is advantageously covered with a plastic sleeve or handle grip member 13, preferably injection-molded from thermoplastic material to have the characteristics of semi-rigidity or limited flexibility and a reasonably high friction characteristic on the outer surface to create a comfortable hand hold and to enhance retention of the tool in the hand of the user. The hand grip 13 may be formed with an outwardly projecting protuberance 13' at the upper end, as shown, to prevent excessive slipping movements of the hand in relation to the hand grip. The hand grip 13 also creates a greater surface area in contact with the hand to diffuse the forces acting on the user's hand when squeezing the handles. By totally encircling the handle 12*b*, the user's hands are also protected from the sharp edges on the handles created by the sheet metal stampings forming the handles, as to be described in connection with FIGS. 10–12.

Figure 2:
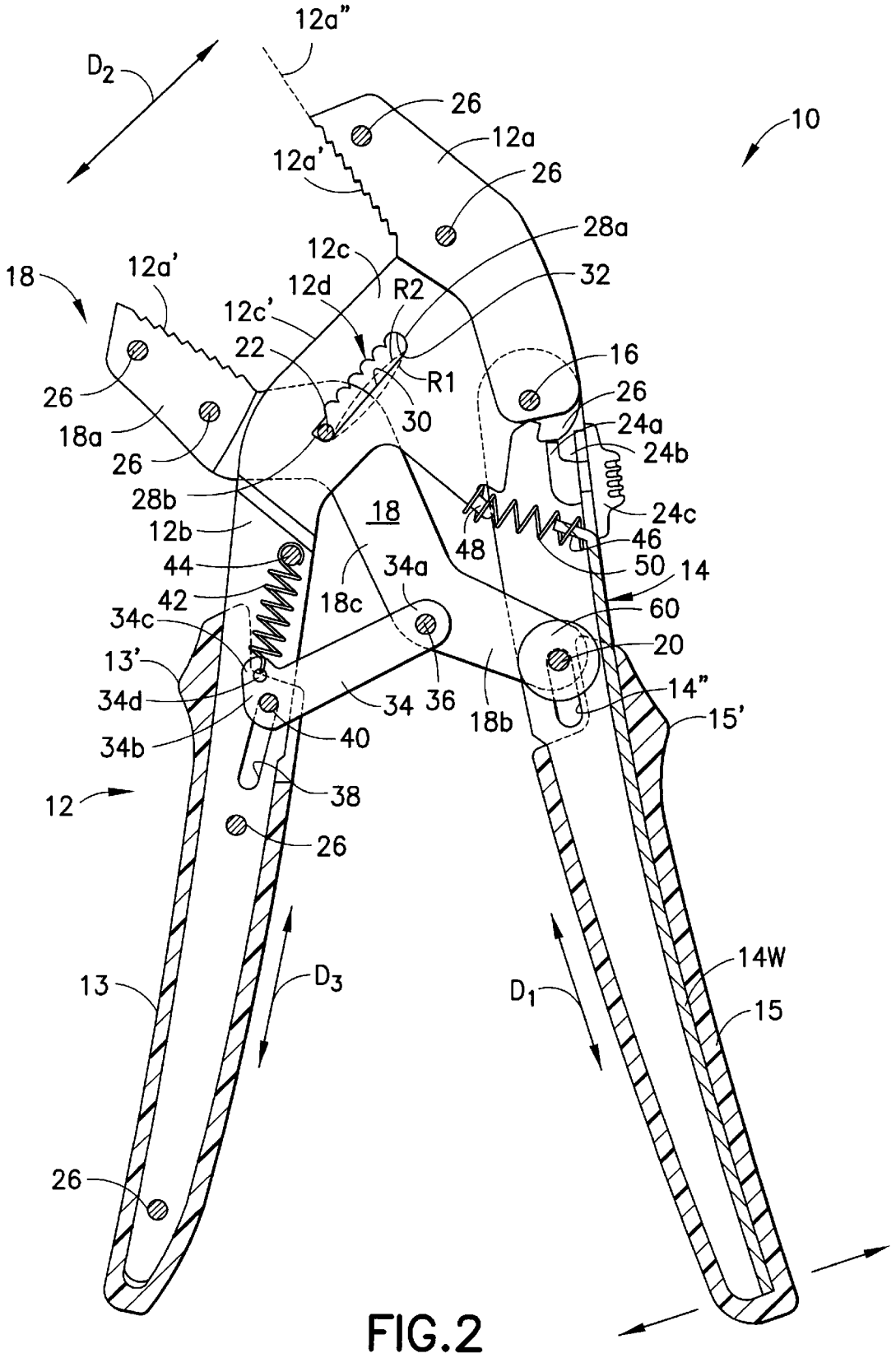
FIG. 2 is a side elevational view of the pliers shown in FIG. 1, partially in section, to illustrate the operative mechanical components within the handles and to show the details of the locking mechanism.
Figure 3:
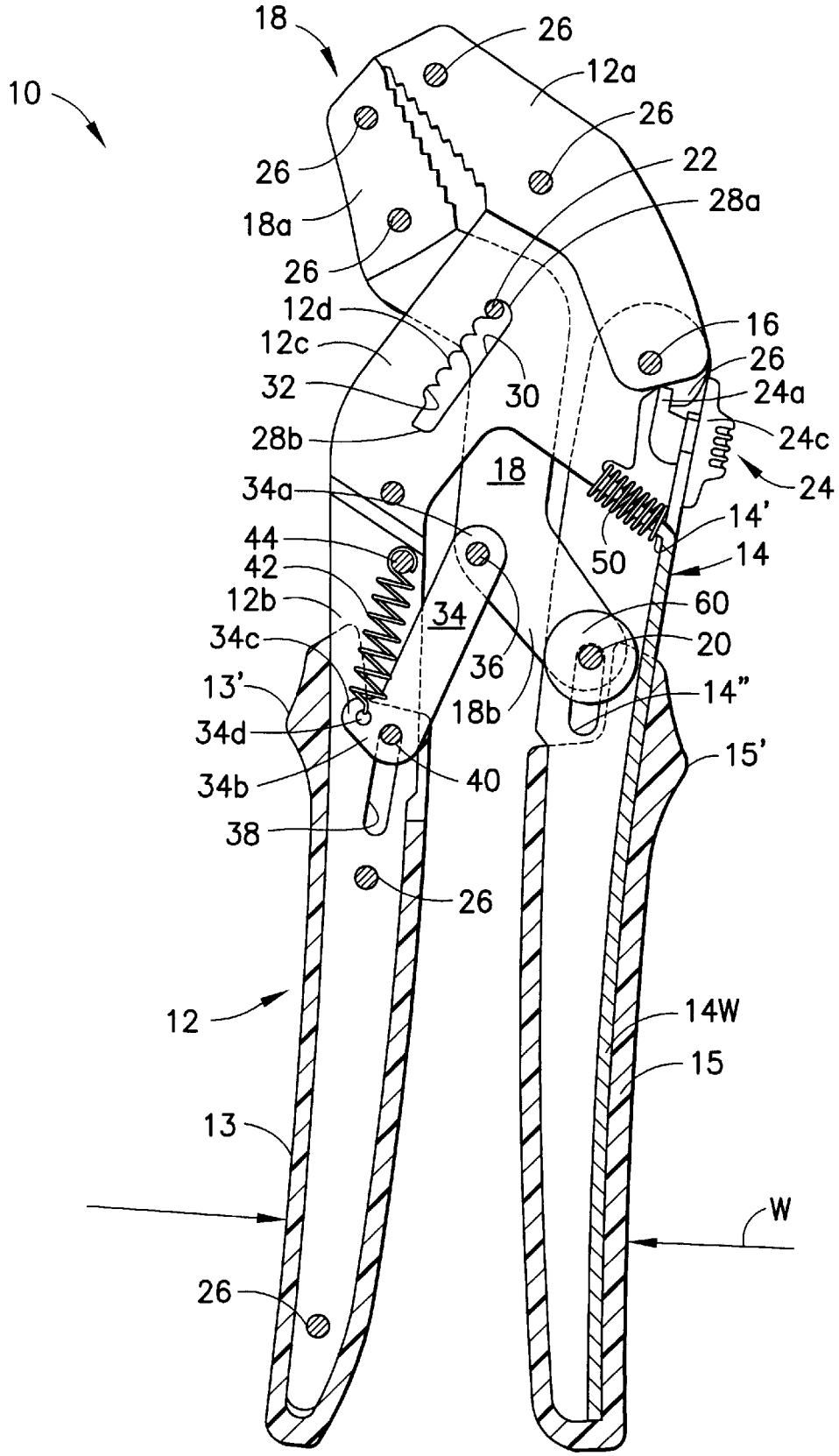
FIG. 3 is similar to FIG. 2 but showing the handles and jaws in the fully closed position, without a work being gripped between the jaws, and showing the details of the lock mechanism when actuated or enabled to maintain the handles and jaws in the closed position.
Figure 4:
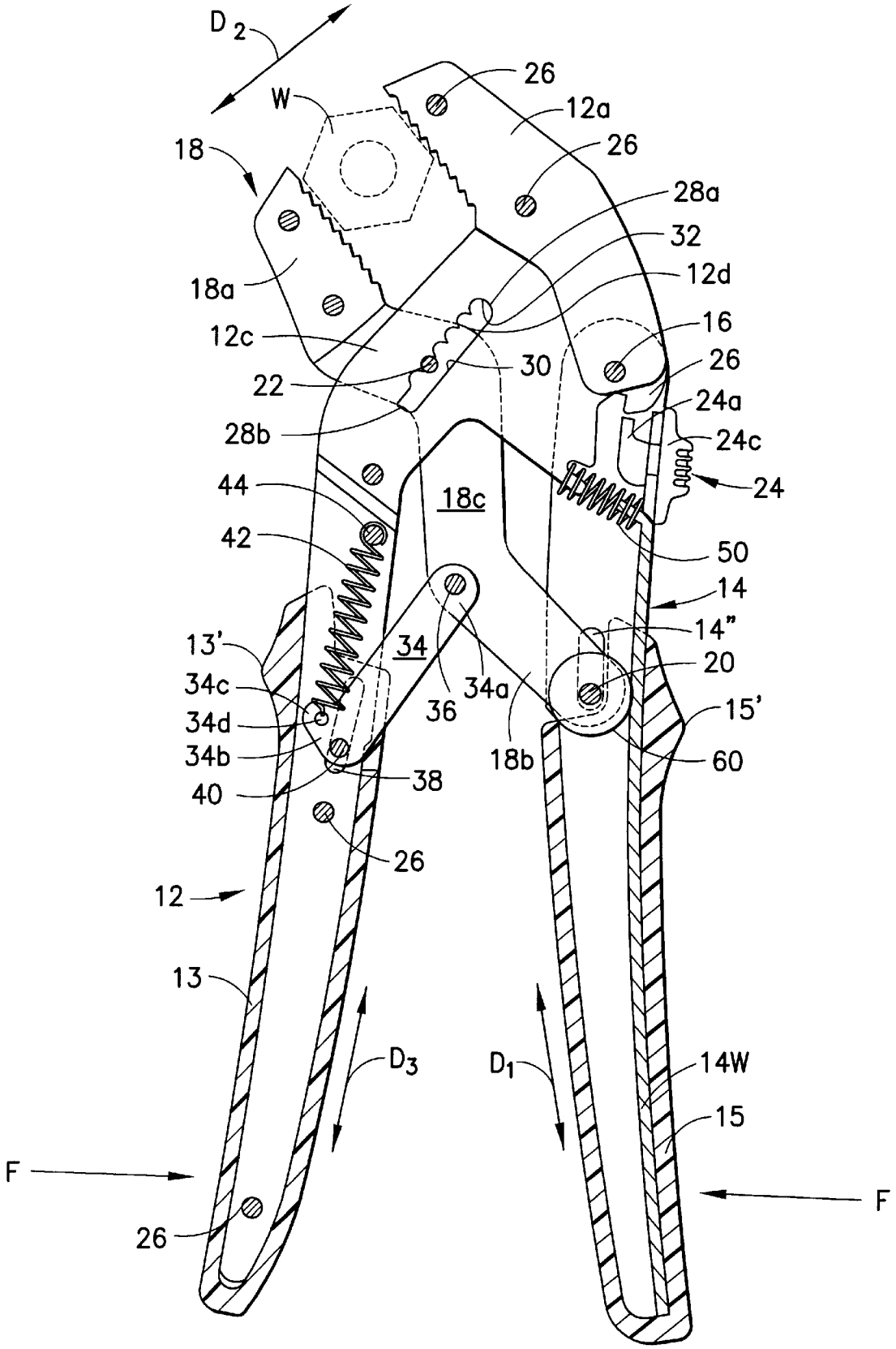
FIG. 4 is similar to FIG. 3, but showing the handles and jaws at intermediate positions between those shown in FIGS. 2 and 3 when gripping a work between the jaws, and further showing the lock of the pliers disabled or disengaged to allow the handles and jaws to separate.

A second or movable elongate handle 14, also provided with a protective sleeve or covering 15, similar to the sleeve 13, and a protuberance 15', similar to 13', is connected at the upper end 14' to the first jaw 12*a* for pivotal movements about a pin 16 between the normally open or releasing position, as shown in FIGS. 1 and 2, a closed position (FIG. 3) or an intermediate gripping position (FIG. 4).

The first handle 12*b* will also be referred to as the "fixed" handle while the second handle 14 will also be referred to as a "movable" handle. While, clearly, both handles can move, these designations will be used to establish references for relative movements and to facilitate the description of the pliers.

A second elongate member, generally designated by the reference number 18, is provided which has a second jaw 18*a*, at one end, arranged in substantial opposition to the first jaw 12*a*, and having another end 18*b* mounted on the movable handle 14 for movement in response to pivoting of the movable handle 14 relative to the first jaw 12*a*. The second elongate member also has a second neck portion 18*c* extending between and connecting the second jaw 18*a* and the other pivoted end 18*b*.

The end 18*b* of the second elongate member 18 is, in the embodiment illustrated, mounted both for pivotal and for linear movements along a general direction $D_1$ of the handle 14 (FIG. 2). This is achieved by the use of a transverse pin 20 mounted on the end 18*b* of the second elongate member 18 which passes through and is captured within opposing slots 14" (only one slot being visible in FIG. 1), formed on opposing walls of the handle 14 die cut from a sheet metal blank and formed to have a substantially U-shaped cross section, for generally linear movements along the direction $D_1$ between initial and extended positions. The pin 20 is shown in its initial position in FIG. 1, when the pliers is in its fully open or releasing position.

As best shown in FIG. 2, an elongate slot or channel 12*d* is provided in the neck portion 12*c*. A stop pin 22 is mounted on the neck portion 18*c* and is arranged to selectively move along the slot or channel 12*d* generally linearly relative to the neck portion 12*c* along a direction $D_2$ substantially parallel to the direction of movements between the jaws 12*a*, 18*a* a prior to engagement of a work by the jaws. This is achieved by mounting the stop pin 22 on the neck portion 18*c* and capturing it within elongate slot or channel 12*d*, having ends 28*a*, 28*b*, which permits the locking pin 22 to undergo pivoting and linear sliding motions within the slot 12*d*. A lower surface of the slot 12*d*, as viewed in FIG. 2, is provided with a generally smooth guide surface 30 (FIG. 2), while the opposite surface is provided with a series of arcuate recesses or notches 32, which may be in the shapes of circular arcs. However, the specific configurations of the recesses or notches 32 are not critical and may assume other shapes, as long as the stop pin 22 can engage such recesses and stop further sliding movements of the pin 22 through the channel 12*d* upon engagement of the work. The stop pin 22, which can slide, under certain circumstances to be described, within the slot 12*d*, can also pivot when received within one of the recesses or notches 32. The stop pin 22 may be fixed against rotation about its own axis on the neck portion 18*c* without adversely affecting the functions provided by the pin. The stop pin 22 initially slides along the smooth surface 30 from the lower end 28*b*, as shown in FIG. 2, towards the upper end 28*a*, as shown in FIG. 3, before a work is gripped by the jaws. However, as soon as a work W is gripped between the jaws (FIG. 4), the stop pin 22 is urged into one of the notches or recesses 32 to limit continued movements of the second jaw 18*a* relative to the first jaw 12*a* to pivoting movements of the second jaw 18*a* relative to the first jaw about the pin 22. As soon as the work W is gripped between the jaws and, therefore, the jaws 12*a*, 18*a* can no longer move closer to each other along the direction $D_2$, the stop pin 22 moves in a direction generally perpendicular to the smooth guide surface 30 to be received in that notch or recess 32 generally opposite to the point at which the pin was situated on the smooth surface 30 when engagement with the work took place. Laminations 33 forming the jaws 12*a*, 18*a* are secured to each other by rivets 26.

One important feature of the present invention is the provision of a separate elongate member 18, which carries the second jaw 18*a* but which is not integrally formed with the second or movable handle 14, that serves as a second lever, thereby creating, with the handle 14, a compound lever pliers with a compound lever. Another important feature of the present invention is the provision of a fourth distinct element, namely an elongate link 34, which has one end 34*a* (FIG. 2) movably mounted on the second neck portion 18*c*, and another end 34*b* movably mounted on the first elongate handle 12*b* for movements relative to the second elongate member 18 in response to the movements of the first elongate member 12. The link 34, in the embodiment shown, has an end 34*b* mounted for movement in a generally linear direction along a second predetermined length of the fixed handle 12*b* (FIG. 2) between initial and extended positions. This is achieved by means of an elongate slot 38 of predetermined length which extends generally along a direction $D_3$, which is generally parallel to the length direction of the handle 12*b*. The end 34*b* of the link 34 is mounted for linear and rotational movements by means of a transverse pin 40 mounted on the link and captured within the elongate slot 38 (only a single slot shown in FIG. 2). Prior to engagement of the work, the pin 40 is shown at the upper or initial position in FIGS. 1–3. The position of the pin 40 is shown moved to an extended position in FIG. 4, after the work W has been gripped between the jaws, and the handles 12*b*, 14 are squeezed together by applying forces F to the handles.

Suitable biasing means is provided for normally maintaining the jaws 12*a*, 18*a* and the handles 12*b*, 14 in normally open or releasing positions as shown in FIGS. 1 and 2, when no gripping forces are applied to the handles and for normally maintaining the end 34*b* of the link 34 in the initial position within the slot 38 as shown in FIG. 2, and the end 18*b* of the second elongate member 18 at the initial position of the slot 14", as shown in FIGS. 1 and 2, prior to engagement of a work by the jaws. Such biasing means includes a helical spring 42, under tension, having one end secured to a protuberance or substantially normal extension 34*c*, through a hole 34*d* as shown, and the other end is secured to a transverse post 44 mounted on the handle 12*b*. Also, as best shown in FIG. 2, a tab or projection 46 is provided which extends inwardly into the center of the handle 14 and an opposing rearward projection 48 extends from the neck portion 12*c* in substantial spaced alignment with the projection 46 to accommodate a helical spring 50, in compression. Using the first elongate member 12 as a fixed reference point, it is clear that the compression spring 50 will normally urge the second or movable handle 14 to rotate in a counterclockwise direction about the pivot pin 16, as viewed in FIG. 2, to separate the handles 12*b*, 14. A separation of the handles will, in turn, cause the pivot pin 20 to move to the upper, initial position, as shown in FIG. 2, thus also urging the second elongate member 18 to move downwardly and to thereby urge the stop pin 22 to the lower end 28*b* of the slot 12*d*. The tension spring 42 will have a similar effect on the second elongate member 18 by pulling on the extension 34*c*, causing the link 34 to rotate in a clockwise direction about the pivot pin 40.

As the handles 12*b*, 14 are closed, the compression spring 50 is further compressed, as shown in FIG. 3, while the tension spring 42 is further stretched as a result of the counterclockwise rotation of the link 34. The springs 42, 50 will normally urge the jaws and the handles to revert to the open or releasing position shown in FIG. 2 when the forces F (FIG. 4) on the handles are removed. It will also be noted from FIG. 3 that the stop pin 22 moves to the upper edge 28*a* of the slot or channel 12*d* when the handles and jaws are fully closed, prior to the work being seized between the jaws.

The stop pin 22 normally moves or slides upwardly from the lower end 28*b* to the upper end 28*a* of the slot or channel 12*d*, by sliding along the smooth guide surface 30, when a work W comes into contact with the jaws 12*a*, 18*a*, and the work W is sufficiently rigid to prevent the jaws from moving any closer to each other. However, application of increased forces on the handles to bring these closer together relative to each other initially causes the movable handle 14 to rotate the second elongate member 18 in a generally clockwise direction about the pivot pin 36. This introduces an upwardly directed force component on the member 18 which causes the stop pin 22 to leave the smooth guide surface 30 and move to the other side of the slot or channel 12*d*. This is illustrated in FIG. 4, in which the stop pin 22 has moved from the smooth surface 30 across the slot 12*d*, to engage one of the arcuate recesses or notches 32. However, since the jaws cannot move closer to each other, the stop pin 22 becomes a pivot point about which the second elongate member 18 pivots in response to continued application of closing force on the movable handle 14, which tends to rotate the elongate member I 8 in a generally clockwise direction about the stop pin 22.

An important feature of the invention is the provision of the slot 14" and the slot 38 which provide additional degrees of freedom of linear movements after the work W has been gripped between the jaws. Sufficiently strong forces applied to the handles to bring the handles together causes the pin 20 to move from the initial position within the slot 14" towards an extended position, as shown in FIG. 4. Such extended position may be at the lower end of the slot 14" or at an intermediate position, depending on the size of the work W and the magnitude of the forces F (FIG. 4) applied to the handles.

Continued transmission of forces by the member 18 on the link 34, by means of the pivot pin 36, which forces the link to rotate in a counterclockwise direction, requires that the pin 40 move downwardly within the slot 38. The simultaneous counterclockwise rotation and the linear movement of the end 34*b* of the link 34 within its associated slot 38 further stretches the tension spring 42. The linear movement of the pin 20 within the slot 14" rotates the member 18 in a clockwise direction to primarily compensate for the skewed or nonparallel, relationship of the handles when significant forces are applied thereto. The movement of the pin 20 in the slot 14" also promotes the gripping surfaces of the jaws 12*a*, 18*a*, on which the teeth or serrations 12*a*' are provided, to reorient themselves into substantially parallel planes, as shown in FIG. 4. However, the freedom of linear movement of the pin 20 within the slot 14" also permits the movable handle to continue to pivot in a clockwise direction after a work has been gripped, thereby permitting the handles to move closer together to a desired, substantially parallel spacing "w" (FIG. 3). Similarly, linear movements of the pin 40 within the guide slot 38 primarily allow both the gripping surfaces of the jaws to attain a substantial parallelism in relation to each other, substantially independently of the size of the work, and also promote the adjustment of the handles to move to spacing "w" for a wide range of sizes of work W.

In accordance with the presently preferred embodiment, there is provided a locking mechanism 24 for locking the second or movable handle 14 in the fully closed position, as shown in FIG. 3, notwithstanding the biasing forces applied by the springs 42 and 50. The locking mechanism 24 may take a number of different forms, although in the embodiment shown in FIG. 2, a hook member 24*a* is provided which is spaced from the outside wall of the movable handle 14 to create a receiving space 24*b*. The hook member 24*a* is slidably movable upwardly and downwardly so as to selectively engage a detent 26 formed on the neck portion 12*c* in proximity to the handle 14. Advantageously, a suitable button or finger-gripping element 24*c* is provided which is coupled to the hook member 24*a* and is slidably mounted on the handle so that the button 24*c* may be conveniently engaged by the thumb of the user to move the hook 24*a* when the handles are brought into the closed positions, as shown in FIG. 3. It will be evident that in this engaged position of the hook 24*a* and the detent 26 the movable handle 14 will remain in the closed position notwithstanding the forces of the springs tending to act to open the handles and the jaws. However, in the condition shown in FIG. 3, a user can readily engage the button or finger grip 24*c* with the thumb to push or pull down the button and the hook 24*a* for disengagement from the detent 26, thereby allowing the springs to open the jaws and the handles to the positions shown in FIGS. 1 and 2.

Figure 5:
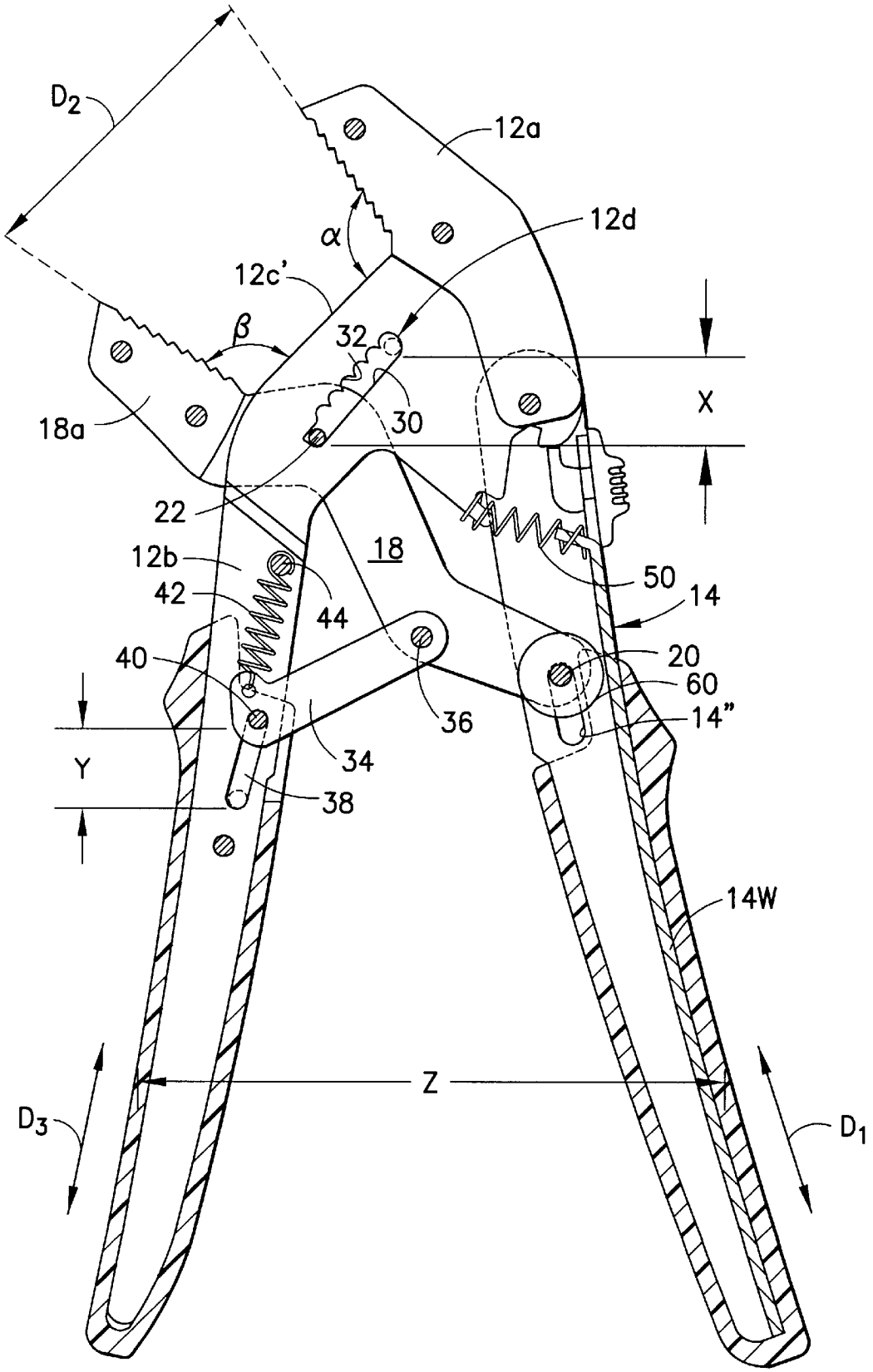
FIG. 5 is a side elevational representation of the pliers similar to FIG. 2, defining linear and angular dimensions that bear on the operation of the pliers.

Referring to FIG. 5, in the presently preferred embodiment, the angle $\alpha$ of the stationary or first jaw 12*a* with respect to the base 12*c*', which extends in a direction substantially parallel to the direction $D_2$ of movements of the jaws in relation to each other, is approximately 110°. However, the angle $\alpha$ is not critical, and may be within the range of 90°–110°, being in the preferred range preferred range of 95°–100°, in order to achieve parallelism of the jaws when gripping a work. This angle can readily be changed to any other suitable angle consistent with the sizes of the works expected to be engaged, as well as consistent with the predetermined lengths of the slots 14" and 38 since these establish the extent to which desired compensation can take place.

In order to make the jaws 12*a*, 18*a* parallel at the largest gripping size, the slots or guides 14", 38 preferably allow for displacements "x" and "y" (FIG. 5) to be substantially equal for grip separation "z" to remain substantially constant at spacing "w" (FIG. 3) for all sizes of gripping when the pliers is closed. In this configuration if the direction of the slots is modified they can be made slightly shorter or longer.

An important aspect of the invention is the requirement that the jaws be substantially parallel in their gripping position for substantially all anticipated sized works. In order to achieve that requirement, the "x" dimension does not change until the second jaw engages the work piece. At that moment, the jaws are not yet totally parallel. After the jaws engage the work piece, however, and the stop pin 22 engages one of the notches 32, the elongate link 34 begins to move downwardly in the slot 38 until the jaws reach parallelism. This movement is dependent on the position of the stop pin 22 in one of the notches or recesses 32. When the stop pin 22 is in the first recess or groove (approximate to the initial position shown in FIG. 2), the joint does not move at all. When the stop pin 22 is in the last notch or recess 32 (as in FIG. 3), the pin 40 moves the maximum amount. The length of the slot must be sufficient to allow this movement of the pin 40 until the jaws are parallel. The jaws can actually be made to grip in substantial parallel relationship for all positions of the jaws and all sizes of works W except for the smallest grip position. However, the parallel orientation of the jaws when in the fully closed position (FIG. 3) is not critical since no work is engaged. This is equally true in traditional groove joint pliers (not self-adjusting), in which the tips of the jaws touch each other while the bases of the jaws are spaced further apart from each other.

The slot 14" in the movable handle 14 is preferably positioned and sized such that the spread "w" (FIG. 3) of the handles will remain substantially the same for all contemplated sizes of works. While the handle separation cannot be made absolutely constant, the size and direction of the slot 14" can minimize the changes in separation.

In order to minimize sliding friction between the pin 20 and the edges of the slot 14", in which significant friction forces may be generated, there is advantageously provided a wheel or disk 60 rotatably mounted on the pin 20, the diameter of the wheel or disk 60 being selected to cause the wheel to contact the rear wall of the handle 14, as best shown in FIGS. 2–4. In this way, while the pin 20 moves along the guide slot 14", the wheel 60 minimizes the sliding friction that would normally be applied between the pin 20 and the elongate edge surfaces of the slot 14". To ensure proper operation and continued contact of the wheel 60 with the rear wall 14*w* the slot 14" is arranged parallel to the rear wall 14*w* so that the pin 20 remains equally spaced from the rear wall and so that the wheel continues to contact the rear wall and sliding friction between the pin 20 and the edges of the slot 14" is minimized or eliminated.

While the slot 38 is primarily designed to maintain the gripping surfaces of the jaws substantially parallel while engaging the work, the slot 14" on the movable handle is primarily there to allow the handles 12*b*, 14 to adjust to be parallel and have the desired spacing "w". Depending on the size of the pliers, the rotation of the jaw needed in a fully closed position compared to a fully open position to make the jaws parallel to each other will dictate the position of the pin 20 in the second jaw slot. The disposition, in turn, will dictate how long and in what direction the slot should be on the movable handle, keeping in mind the need to maintain the grip separation "w" to remain substantially constant for all gripping positions. As indicated, the dimensions of "x" and "y" are substantially equal in order to minimize the variations in the spacing "z" and maintain such spacing at a substantially constant value "w". While the orientation of the slot 38 is shown as being substantially parallel to the length direction $D_3$ of the fixed handle, the specific orientation of the slot is not critical, as long as the component "y" is substantially equal to "x". Although the direction of the slot 38 may approach the direction $D_2$ of the slot 12*d*, with some improved results, care must be taken with both slots 14" and 38 not to excessively orient the directions of the slots transversely to the directions $D_1$, $D_3$ of the handles since this might weaken the handles.

The spring 42 in the fixed handle 12*b* that applies biasing forces on the elongate link 34 determines the forces that needs to be applied on the second jaw to cause the stop pin 22 to lock on one of the notches or recesses 32. A spring that is too light will permit even the slightest touch or application of force on the second jaw teeth to make the locking pin 22 leave the smooth guide surface 30 and engage one of the notches or recesses 32. This can be impractical if it constantly occurs at the slightest application of force. Therefore, the tension on the spring 32 must be increased so that only when the jaws engage with the work piece does the stop pin 22 engage one of the notches or recesses 32 in the guide channel or groove 12*d*.

While it is acceptable to leave the pin 40 on the fixed handle 12*b* as a "roll pin," the pin 20 on the movable handle 14 should be a solid hardened pin since tremendous amounts of force are exerted on that pin. In addition to heat treatment of various parts, including the jaws area, the notches or recesses 32 need also be very strong to withstand the significant forces that are transmitted thereto.

Figure 6:
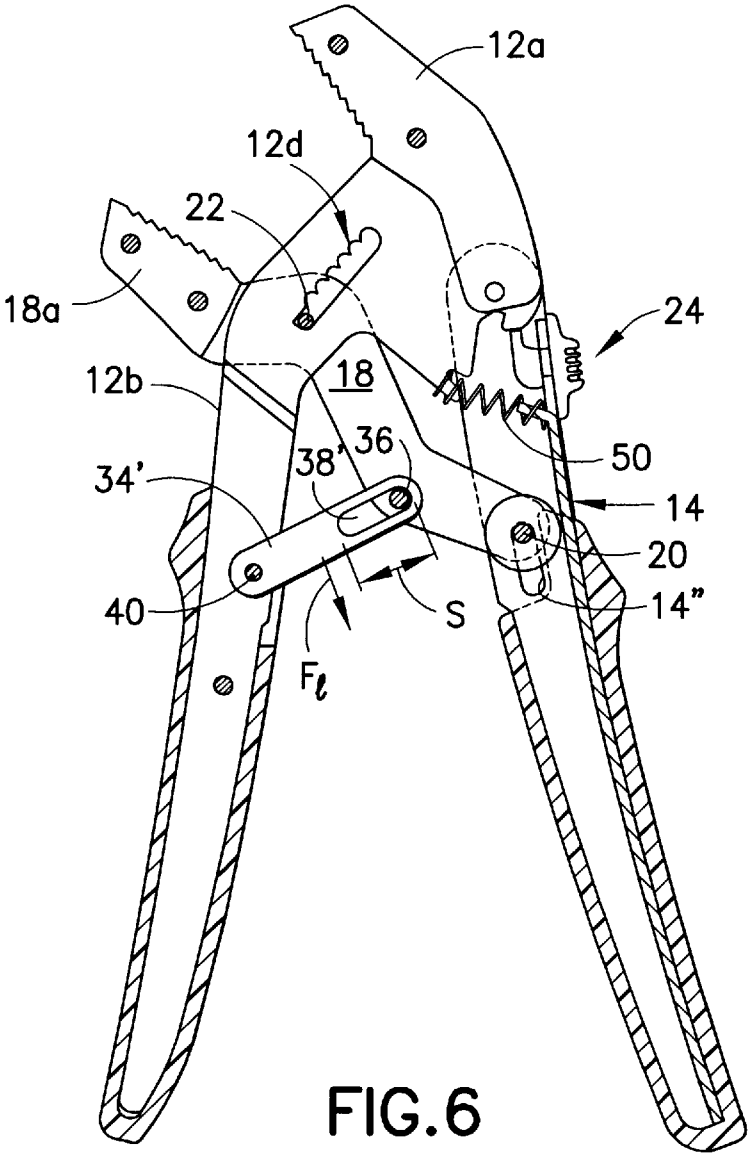
FIG. 6 is similar to FIG. 5, but showing another embodiment of the invention, in which the elongate link is pivotally mounted on the fixed handle but is mounted for pivotal and linear movements at the other end by means of a slot within the link.

While the elongate link 34 is merely pivotally mounted about the pivot pin 36 at its end 34*a*, the link 34' is both pivotally and slidably mounted at its other end 34*b* along the guide slot 38' having a length "s". In FIG. 6 a second degree of freedom of linear movement is provided at the end 34*a* of the elongate link most proximate to the neck portion 18*c*. In this case, the end 34*b* of the link is mounted on the fixed handle 12*b* only for pivotal movement. Inasmuch as a straight link is now used in FIG. 7, a torsion or leaf spring 64 may be used, as suggested in FIG. 8, in which the helical portion of the spring is wound about a post P with the extending arms 64*a* and 64*b* respectively engaging a post 66 on the fixed handle 12*b* and the link 34. In this arrangement, with the spring 64 under torsion, a clockwise biasing force $F_1$ is applied to the link 34, as in the original embodiment shown in FIGS. 1–4.

Figure 7:
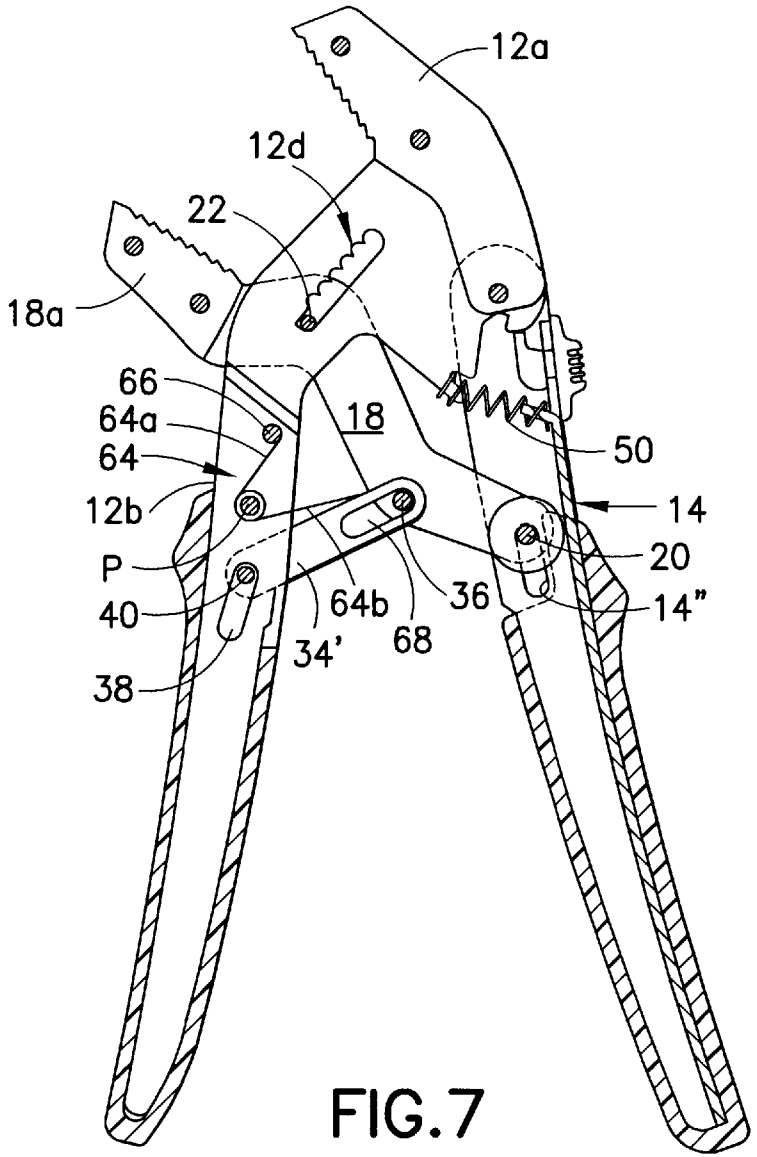
FIG. 7 is similar to FIG. 6 but showing a further embodiment in which the elongate link is pivotally and linearly movable at both ends thereof, and showing a torsion leaf spring for normally urging the elongate link to move in a generally clockwise direction, as viewed in FIG. 8, relative to the fixed handle.

FIG. 7 is a further embodiment in which three guide slots are used, in addition to the guide slot or channel 12*d* in the neck portion 12*c*. The guide slots 14" and 38 are the same as previously discussed in connection with FIGS. 1–4, while the additional guide slot 68 corresponds to the additional guide slot 38' shown in FIG. 6. This embodiment shown in FIG. 7 has, in effect, three separate degrees of freedom of linear movement, which provides additional versatility in adjusting the tool, although the selection of the spring sizes may be more critical and the ranges of operation may be more limited than the version shown in FIGS. 1–4.

Figure 8:
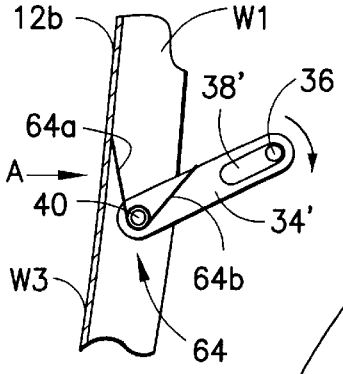
FIG. 8 is a partial side elevational view showing another arrangement for mounting a torsion leaf spring about the pivot pin about which the elongate link is mounted on the fixed handle.
Figure 9:
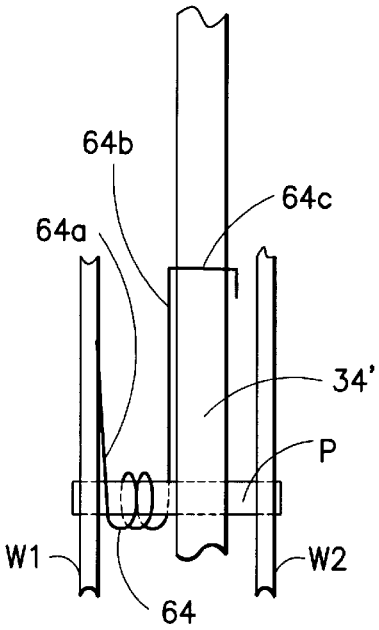
FIG. 9 is an end elevational view of the spring and the elongate link as viewed along direction A in FIG. 8, showing how the spring couples with the elongate link and with the fixed handle.

In FIG. 8 an alternate arrangement of the torsion or leaf spring 64 is illustrated in which the upper leg 64*a* abuts against the front wall W3 of the handle while the second leg 64*b* engages the link 34. As before, a force is applied to urge the link to rotate in a clockwise direction, while eliminating the need for a special post 66. In FIG. 9 a schematic view is illustrated showing the details of construction in FIG. 8 as viewed from direction A with the front or end wall W3 of the handle removed.

Figure 10:
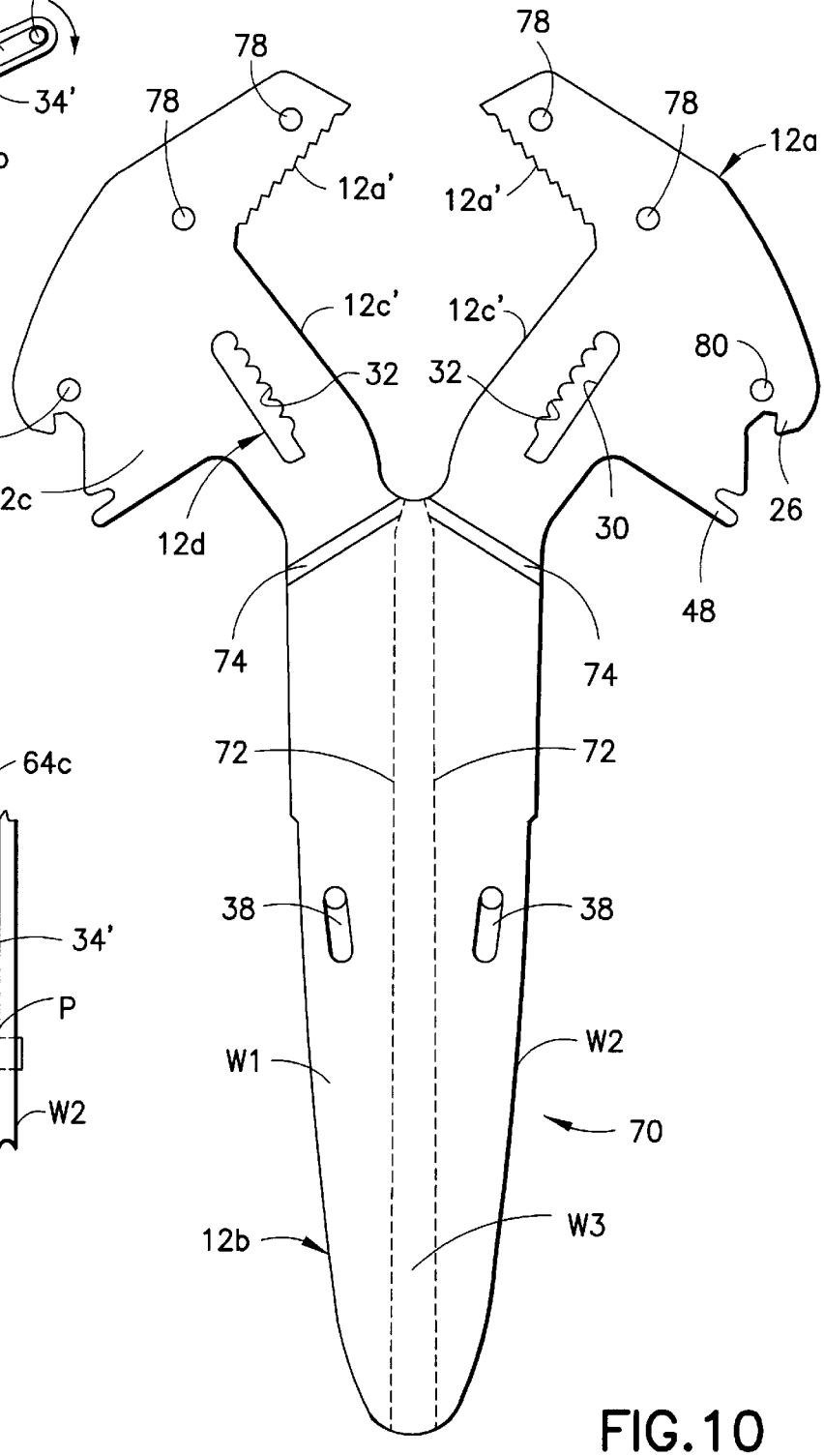
FIG. 10 illustrates a side elevational view of a blank die cut from sheet metal of the type that may be used to construct the pliers in accordance with the present invention, prior to forming.
Figure 11:
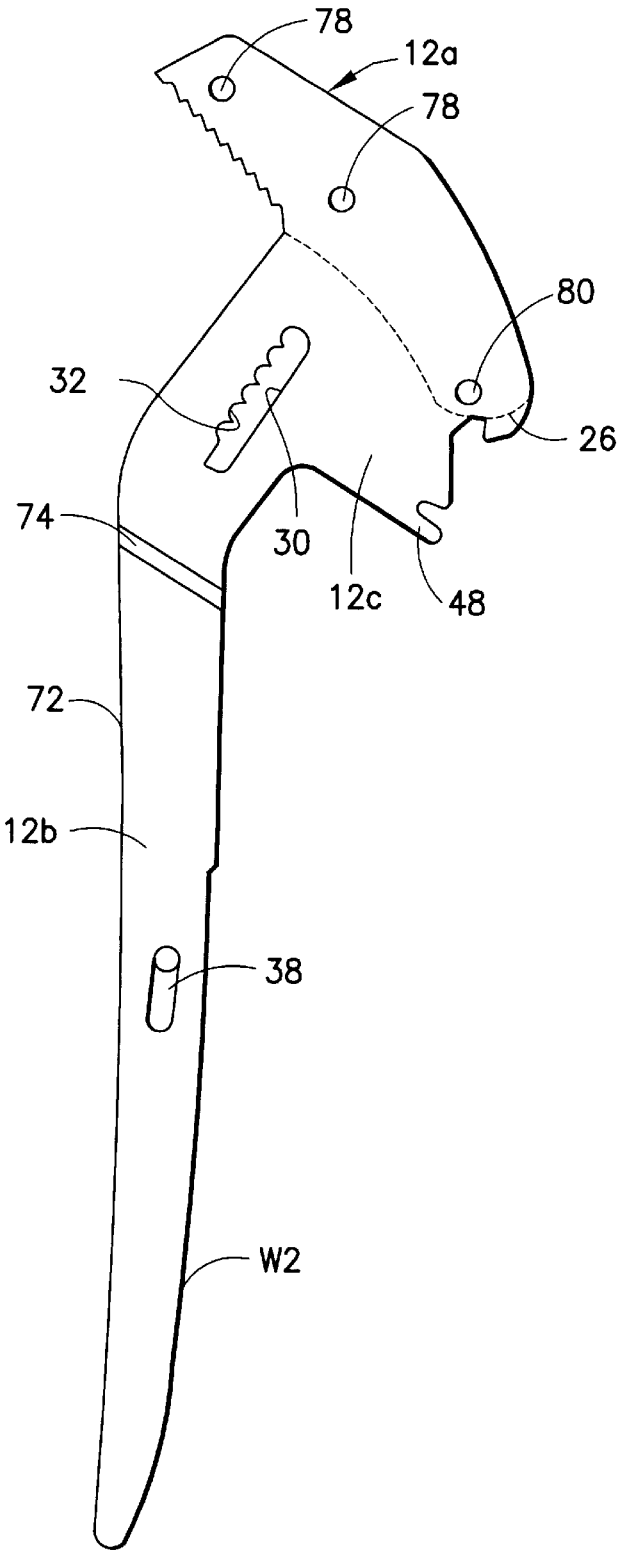
FIG. 11 is similar to FIG. 10, but showing the blank of FIG. 10 after it has been folded or formed to create the first elongate member carrying the first jaw and showing, in dash outline, the shapes of the first jaw pieces or laminations that are used to increase the width of the fixed jaw.
Figure 12:
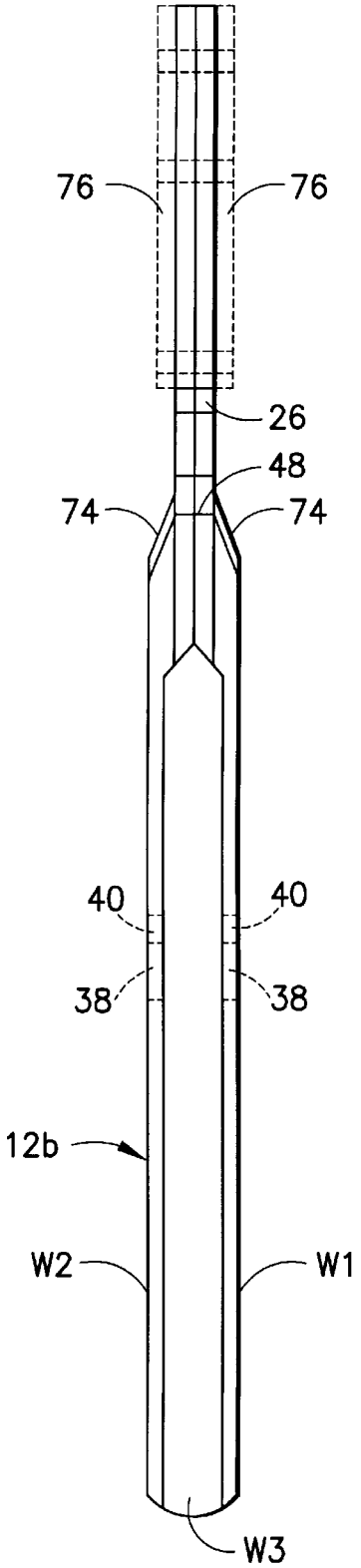
FIG. 12 is a rear elevational view of the folded elongate member shown in FIG. 11, with the first jaw pieces in dash outline.

Referring to FIGS. 10–12, a one piece blank 70 is illustrated which is formed by stamping one piece of sheet metal formed to bend the blank to its final shape, as illustrated in FIGS. 11 and 12. In this way, some of the assembly labor can be eliminated and the number of parts used minimized. The blank 70 is provided with bending or fold lines 72 that define side walls W1 and W2 and an end wall W3 when the blank is formed into the first elongate member 12 of substantially U-shaped cross section. The step down surfaces 74 allow the side walls W1, W2 to remain spaced from each other while the portions of the blank which form the jaw and neck portions are brought into contact with each other as best shown in FIG. 12. By using an additional jaw piece or lamination 76 on each side of the bent blank as shown, the thickness of the jaws 12*a*, 18*a*, can be increased and the jaws strengthened. Holes 78 are provided to hold all of the laminations by use of the rivets 26. The holes 80 are for receiving the pivot pin 16. This construction also provides a smooth grip area for the first elongate member 12 and also results in the rearward projection 48 needed for retaining the spring 50. The end or closed back wall W3 of the handle also serves as a bearing surface for the leaf spring that biases the link/lever.

While the primary components are shown formed of blanks that are bent or folded to produce the finished handles, the handles and other elements of the pliers can be formed of stamped, flat, suitably shaped laminations that are joined together, such as by riveting. Such design, clearly, avoids the step of bending or folding.

There are important advantages and features of the pliers in accordance with the present invention. First, the jaws grip the parts or work in truly parallel fashion. No other pliers of this nature currently exist in the market. Also, the handles remain substantially constant in any gripping position, regardless of the size of the parts. This optimizes the gripping power of the user and the spacing is intended to provide the most comfortable grip size for average users. The gripping power of the pliers is higher than the gripping power of any other pliers of this nature in the market, relying on a double lever or compound lever mechanism as opposed to the simple or single lever pliers that have been known in the past. With the described preferred embodiment, the grip capacity of the pliers in parallel jaws position should be at a minimum 0.75 inches for 7½" size, and at a minimum of 1¼" for the 9¾" version. These values may be selected to be different, if desired.

Although the present invention has been described in relation to particular embodiments thereof, many other variations, modifications and other uses will become apparent to those skilled in the art. For example, the slots or guide channels 12*d*, 14" and 38 need not be straight, but may be curved in one direction (e.g. R1 in FIG. 2) or in the other direction (e.g. R2 in FIG. 2) to provide different operating characteristics. It is the intention, therefore, that the present invention not be limited by the specific disclosure of the embodiments therein, but only by the scope of the appended claims.

What we claim is:

1. A self-adjusting pliers for automatically adjusting to different sized work pieces, comprising:

a first elongate member having a first jaw at one end, a first elongate handle at the other end and a first neck portion between said first jaw and said first handle;

a second elongate handle having one end pivotally connected to said first neck portion for pivotal movements between a normally open or releasing position and a closed or gripping position;

a second elongate member having a second jaw at one end arranged in substantial opposition to said first jaw and having an other end mounted on said second elongate handle for movements responsive to pivoting movements of said second elongate handle relative to said first elongate member, and a second neck portion between said second jaw and said other end of said second elongate member;

an elongate link having one end movably mounted on said second neck portion and another end movably mounted on said first elongate handle for movements responsive to movements of said second elongate member relative to said first elongate member;

first elongate guide means on said first neck portion arranged along a direction substantially parallel to the direction of relative movements between said jaws prior to engagement of a work by said jaws;

second elongate guide means for selectively guiding one of said ends of said link generally linearly along a first predetermined length of at least one of said first handle and said second neck portion between initial and extended positions;

third elongate guide means for selectively guiding said other end of said second elongate member along a second predetermined length of said second handle between initial and extended positions;

stop means associated with said first guide means for selectively terminating continued generally linear movements of said second neck portion along said first guide means following engagement of a work by said jaws and limiting continued generally linear relative movements of said jaws to pivoting movements of said jaws about said stop means; and biasing means for urging said handles to normally separate when no gripping forces are applied to said handles and for normally maintaining said one movable end of said link at said initial position of said second guide means and said other end of said elongate member at said initial position of said third guide means prior to engagement of a work by said jaws, said second jaw being arranged to advance towards said first jaw prior to gripping of a work by said jaws, gripping of the work between said jaws causing said stop means to convert further application of forces to said handles to relative pivoting movements between said jaws and causing said jaws to move to substantially parallel orientations primarily due to compensating linear movements of said one movable end of said link and second elongate member from said initial positions towards said extended positions along said respective second and third guide means against the forces of said biasing means.

2. A self-adjusting pliers as defined in claim 1, wherein said one end of said elongate link is pivotally connected to said second neck portion.

3. A self-adjusting pliers as defined in claim 1, wherein said biasing means comprises first biasing means for primarily urging said handles to normally separate and second biasing means for primarily urging said other end of said link at said initial position.

4. A self-adjusting pliers as defined in claim 3, wherein said elongate link comprises an angled lever arm having first and second portions defining directions arranged at a predetermined angle to each other, said first portion extending between said second neck portion and said first elongate handle and said second portion having a free end connected to said second biasing means.

5. A self-adjusting pliers as defined in claim 3, wherein said second handle has a first engagement member suitable for engaging one end of a helical spring and said first neck portion has a second engagement member suitable for engaging one end of a helical spring, said first and second engagement members being generally in opposition to each other, said first biasing means comprising a helical spring extending between and engaged by said respective first and second engagement members.

6. A self-adjusting pliers as defined in claim 5, wherein said helical spring comprises a compression spring.

7. A self-adjusting pliers as defined in claim 4, wherein said second biasing means comprises a spring having one end fixedly connected to said first handle and having another end connected to said second portion.

8. A self-adjusting pliers as defined in claim 7, wherein said spring comprises a tension spring.

9. A self-adjusting pliers as defined in claim 4, wherein said predetermined angle is approximately 90°.

10. A self-adjusting pliers as defined in claim 1, wherein said first elongate guide means comprises an elongate slot and said locking means comprises a locking pin extending through said elongate slot and having ends mounted on said first neck portion.

11. A self-adjusting pliers as defined in claim 10, wherein said elongate slot is formed of two elongate opposing surfaces, one elongate surface, more proximate to said second handle, being generally smooth and another elongate surface, more remote from said second handle, being provided with a predetermined number of projecting protuberances, said locking pin being normally urged by said biasing means to ride against said smooth surface when said handles are moved toward said closed or gripping position prior to engagement of a work by said jaws, and normally being urged against one of said projecting protuberances following engagement of a work by said jaws with continued closure of said handles to prevent further linear movements of said locking pin and to convert further closure of said handles to pivoting of said second jaw about said locking pin substantially at the location of the engaged projecting protuberance.

12. A self-adjusting pliers as defined in claim 10, wherein said other elongate surface is formed as a plurality of spaced arcuate recesses each dimensioned to receive said locking pin.

13. A self-adjusting pliers as defined in claim 1, wherein said second elongate guide means comprises an elongate slot formed within said first handle, a pin being mounted on said elongate link captured in said slot for movement between said initial and extended positions.

14. A self-adjusting pliers as defined in claim 1, wherein said third elongate guide means comprises an elongate slot formed within said second handle, a pin being mounted on said second elongate member captured in said slot for movement between said initial and extended positions.

15. A self-adjusting pliers as defined in claim 1, wherein said first predetermined length allows said other end of said elongate link to move sufficiently following engagement of a work by said jaws to substantially compensate for the size of the work by pivoting said second neck portion to move said second jaw into substantially parallel alignment with said first jaw.

16. A self-adjusting pliers as defined in claim 1, wherein said second predetermined length allows said other end of said second elongate member to move sufficiently following engagement of a work by said jaws to substantially compensate for the size of the work by permitting said second handle to continue pivoting following engagement of the work to move said second handle into substantially parallel alignment with said first handle.

17. A self-adjusting pliers as defined in claim 1, further comprising locking means for selectively locking said handles in said closed or gripping position against the actions of said biasing means.

18. A self-adjusting pliers as defined in claim 17, wherein said locking means comprises a detent on said first jaw and a hook member slidably mounted on said second handle for selectively engaging said detent in the closed or gripping position of said second handle and also selectively disengaging from said detent while in said closed or gripping position to release said second handle to move to said open or releasing position.

19. A self-adjusting pliers as defined in claim 18, wherein said first handle is normally gripped by the fingers of a user and said second handle is normally at least partially engaged by the thumb of the user, and further comprising a thumb-actuated button connected to said hook member for sliding movements therewith and arranged to be conveniently accessible to the thumb to facilitate engaging and disengaging of said locking means while said handles are held in said closed or gripping position.

20. A self-adjusting pliers as defined in claim 1, wherein components or elements forming the plier are made of sections of sheet material.

21. A self-adjusting pliers for automatically adjusting to different sized work pieces, comprising:

a first elongate member having a first jaw at one end, a first elongate handle at the other end and a first neck portion between said first jaw and said first handle;

a second elongate handle having one end pivotally connected to said first jaw for pivotal movements between a normally open or releasing position and a closed or gripping position;

a second elongate member having a second jaw at one end arranged in substantial opposition to said first jaw and having an other end mounted on said second elongate handle for movements responsive to pivoting movements said second elongate handle relative to said first jaw, and a second neck portion between said second jaw and said other end of said second elongate member;

an elongate link having one end movably mounted on said second neck portion and another end movably mounted on said first elongate handle for movements responsive to movements of said second elongate member relative to said first elongate member;

elongate guide means on said first neck portion arranged along a direction substantially parallel to the direction of relative movements between said jaws prior to engagement of a work by said jaws;

control guide means for selectively moving at least one of the ends of said elongate link and said other end of said second elongate member generally linearly in relation to an associated one or both of said first handle and said second elongate member between initial and extended positions;

stop means associated with said elongate guide means for selectively terminating continued generally linear movements of said second neck portion along said elongate guide means following engagement of a work by said jaws and limiting continued generally linear relative movements of said jaws to pivoting movements of said jaws about said stop means; and biasing means for urging said handles to normally separate when no gripping forces are applied to said handles and for normally maintaining said movably mounted end of said link at said initial position of said control guide means and said other end of said second elongate member at said initial position of said control guide means prior to engagement of a work by said jaws, said second jaw being arranged to substantially linearly advance towards said first jaw prior to gripping of a work by said jaws, gripping of the work between said jaws causing said stop means to convert further application of forces to said handles to relative pivoting movements between said jaws and causing said jaws to move to substantially parallel orientations primarily due to compensating linear movements of said other ends of said link and second elongate member from said initial positions towards said extended positions along said control guide means against the forces of said biasing means, whereby said first and second elongate members and said second elongate handle provide the mechanical advantage of a compound lever and said control guide means provides sufficient adjustability of linear movements of said elongate link and said other end of said second elongate member to move each of said jaws and said elongate handles to substantially parallel orientations substantially independently of the size of the work gripped between said jaws.

22. A self-adjusting pliers for automatically adjusting to different sized work pieces according to claim 21, wherein said second elongate handle exhibits a predetermined curved surface in proximity of said control guide means; and positioning means for guiding said other end of said second elongate member along said predetermined curved surface to maintain a positional relationship between said other end of said second elongate member and said second elongate handle.

23. A self-adjusting pliers for automatically adjusting to different sized work pieces according to claim 22, wherein said control means includes a slot in said second elongate handle generally oriented in a direction of said second elongate handle, said second elongate handle having a wall in proximity to said control guide means that generally follows the direction of said slot, said positioning means including a pin generally transverse to said other end of said second elongate member, and a roller rotatably mounted on said pin and having a diameter to position and maintain said pin substantially centered in said slot by rolling on said wall.

* * * * *